US007699714B1

(12) United States Patent
Reynolds

(10) Patent No.: US 7,699,714 B1
(45) Date of Patent: Apr. 20, 2010

(54) MULTI-FUNCTIONAL GOLF TRAINING APPARATUS AND ASSOCIATED METHOD

(76) Inventor: Nicholas Reynolds, 1520 Tawny Marsh, St. Augustine, FL (US) 32292

( * ) Notice: Subject to any disclaimer, the term of this patent is extended or adjusted under 35 U.S.C. 154(b) by 0 days.

(21) Appl. No.: 12/321,915

(22) Filed: Jan. 27, 2009

Related U.S. Application Data

(60) Provisional application No. 61/068,591, filed on Mar. 10, 2008.

(51) Int. Cl.
*A63B 69/36* (2006.01)

(52) U.S. Cl. ..... 473/212; 473/213; 473/227; 473/409

(58) Field of Classification Search ..... 473/207, 473/212, 213, 214, 227, 276, 409
See application file for complete search history.

(56) References Cited

U.S. PATENT DOCUMENTS 5,145,179 A * 9/1992 Breed ..... 473/212
5,259,621 A * 11/1993 Keefer ..... 473/212
5,447,312 A * 9/1995 Nixon et al. ..... 473/212
5,501,464 A 3/1996 Dalbo
5,865,685 A 2/1999 Thomas
5,902,189 A 5/1999 Schultz
5,904,624 A 5/1999 Martinez
6,857,970 B2 2/2005 Robbins

* cited by examiner

*Primary Examiner*—Nini Legesse

(57) ABSTRACT

A multi-functional golf swing training apparatus includes first and second arm braces that are adapted to be removably attached to user forearms respectively. A first mechanism is provided for pivotally mating the first arm brace to the second arm brace such that the first and second arm braces simultaneously pivot about a first axis. Such a first mechanism can be selectively toggled between unlocked and locked positions such that a desired angle is adjustably and fixedly defined between the first and second arm braces during the golf swing motion respectively. Further, a second mechanism may be provided for resiliently articulating the first and second arm braces about a second axis registered orthogonal to the first axis such that the first and second swivel mounts independently reciprocate along mutually exclusive arcuate paths adjoining the first and second arm braces respectively.

15 Claims, 5 Drawing Sheets

MULTI-FUNCTIONAL GOLF TRAINING APPARATUS AND ASSOCIATED METHOD

CROSS REFERENCE TO RELATED APPLICATIONS

This application claims the benefit of U.S. Provisional Application No. 61/068,591, filed Mar. 10, 2008, the entire disclosures of which are incorporated herein by reference.

TECHNICAL FIELD

This invention relates to golf swing training aides and, more particularly, to a golf training apparatus for assisting a user to develop proper techniques for full swing, chipping, pitching motions as well as grooving a putting stroke.

PRIOR ART

It is generally accepted that golf first emerged in Scotland around 1100 AD. It was based on a Roman game called paganica, which used a bent stick and a leather ball stuffed with feathers. Golf was banned in Scotland from 1457 until 1502 by King James II because its popularity threatened archery practice, which was necessary for national defense. In 1502 England and Scotland signed a treaty of perpetual peace, and the play of golf resumed. Until 1848 golf was played with a feather-stuffed leather ball called "the feathery". In 1848 golfers started using a solid gutta-percha ball called "the gutty", and in 1899 an American inventor introduced the liquid-center golf ball.

The oldest golf club in continuous existence is the Ancient Golf Club of St. Andrews, located in Edinburgh, Scotland (established 1744). This club established many of the standards of the game, including fixing the length of the course at 18 holes. The Royal Montreal Golf Club was established in 1873, and ranks as the oldest North American golf club. In the United States, the St. Andrews Golf Club was established in Yonkers, N.Y. in 1888, and was the first United States golf club. Today, more people play golf than any other outdoor sport. More than 16 million people play golf in the United States alone every year. The game has become popular in many places, including the United States, Canada, England, Western Europe, and Japan.

Conventional golf courses feature either nine or 18 holes. A round of golf consists of 18 holes played in a pre-determined sequence. During play, golfers attempt to keep the ball on the fairway, a stretch of mowed grass between the tee-off site and the putting green, which contains the hole into which the ball must be sunk. The edges of the fairways frequently have obstacles called bunkers. These bunkers may be a mound or a sand trap, or sometimes a body of water such as a stream, pond, lake, river or ocean. About half the holes of an 18-hole course are medium holes, and measure from approximately 280-455 yards in length. The other holes are divided between short holes (less than 280 yards) and long holes (longer than 485 yards). Consequently, 18-hole golf courses occupy between 90 and 250 acres.

The large area of ground required for golf courses gives rise to one major problem faced by the sport: space within which to locate golf courses. This problem is especially pronounced in countries where real estate is scarce, such as Japan. Another problem associated with playing golf is the travel involved in getting to the golf course to start out with. Golf courses are typically located outside cities, in the countryside. Individuals desiring to play must first travel from their homes or workplaces to the location of the golf course.

Many devices have been developed for the game of golf to improve a player's skill level and to increase the level of enjoyment of the game. Much of the focus of golf occurs at the putting green, since the principle object of the game is to sink a golf ball into a golf hole with the least amount of strokes. Several devices have been developed to improve the player's ability to put a golf ball into a golf hole. However, these devices are not designed to assist a user to maintain proper form during a putting stroke, thereby improving the user's all-around skill. Obviously it would be advantageous to develop an invention for this purpose.

Accordingly, the present invention is disclosed in order to overcome all of the above noted shortcomings. The golf training apparatus is convenient and easy to use, lightweight yet durable in design, and designed for assisting a user to develop proper techniques for the full swing, chipping, pitching and grooving a putting stroke. The apparatus is simple to use, inexpensive, and designed for many years of repeated use. This amazing apparatus improves putting, chipping, and the long and short full swing, all with the use of the golf training apparatus.

BRIEF SUMMARY OF THE INVENTION

In view of the foregoing background, it is therefore an object of the present invention to provide a multi-functional golf training apparatus for assisting a user to learn how to properly position and maintain their hands during driving, chipping and putting golf swing motions. These and other objects, features, and advantages of the invention are provided by a multi-functional golf swing training apparatus preferably including first and second arm braces adapted to be removably attached to user forearms respectively.

In one embodiment, the present invention may further include first and second support pads removably coupled to a corresponding lateral face of the first and second arm braces respectively for absorbing operating forces acting against the user forearms during the golf swing motion. Also, a plurality of flexible straps may be wrapped about each of the first and second arm braces. Such flexible straps may be adapted to wrap about the user forearms for maintaining frictional surface contact between the first and second support pads and the user forearms respectively.

The present invention may further include a mechanism for pivotally mating the first arm brace to the second arm brace such that the first and second arm braces simultaneously pivot about a first axis. Such a first axis passes through respective proximal ends of the first and second swivel mounts. In this manner, the pivotally mating mechanism is selectively toggled between unlocked and locked positions such that a desired angle is adjustably and fixedly defined between the first and second arm braces during a golf swing motion respectively. During driving motions, the desired angle may be a variable angle when the pivotally mating mechanism is at the unlocked position. During chipping and putting motions the desired angle may be a fixed angle when the pivotally mating mechanism is at the locked position.

In particular, the pivotally mating mechanism preferably includes first and second swivel mounts removably connected to a corresponding medial face of the first and second arm braces respectively. The second swivel mount is preferably vertically stacked on the first swivel mount, and a spring member is intercalated between the first and second swivel mounts. The spring member is preferably arranged in such a manner that the spring member contracts and expands about the first axis to thereby separate the first and second arm braces to the desired angle.

In one embodiment, the first swivel mount may be provided with an orifice formed therein. One end of the spring member may be removably interfitted within the orifice such that the spring member is prohibited from undesirably disengaging the first swivel mount during the golf swing motion. Each of the first and second swivel mounts preferably includes a geared coupling facing the spring member respectively. In this manner, the geared couplings may be interlocked to each other when the pivotally mating mechanism axially compresses the spring member along the first axis and thereby prohibit the first and second arm braces from pivoting about the first axis during the golf swing motion.

In one embodiment, the pivotally mating mechanism may further include a cam lock for toggling the pivotally mating mechanism between the locked and unlocked positions. Such a cam lock preferably includes a pivot pin linearly positioned through the geared couplings as well as the spring member such that the pivot pin is axially aligned with the first axis. The cam lock may further include a locking arm pivotally coupled to the pivot pin and rotatably situated at the second swivel mount. A locking pin is traversed through the pivot pin and the locking arm respectively to thereby maintain the locking arm pivotally connected to the pivot pin. A plurality of fastening members may be removably engaged to the pivot pin to maintain the pivot pin at a substantially stable position during the golf swing motion.

In one embodiment, the pivot pin is preferably linear and remains statically registered at a fixed position along the first axis when the locking arm is articulated to a locked lowered position. Further, the pivot pin may be axially reciprocated away from the fixed position when the locking arm is articulated to a raised unlocked position and thereafter rotated in a corresponding annular direction about the first axis respectively. Thus, the geared couplings may be caused to travel toward each other and thereby axially compress the spring member when the pivot pin is axially displaced downwardly towards the first swivel mount.

In one embodiment, the present invention further includes a mechanism for resiliently articulating the first and second arm braces about a second axis registered orthogonal to the first axis such that the first and second swivel mounts independently reciprocate along mutually exclusive arcuate paths adjoining the first and second arm braces respectively. Such a resiliently articulating mechanism preferably includes first and second arcuate notches formed in the medial faces of the first and second arm braces respectively, along with first and second pairs of auxiliary spring members interfitted within the first and second arcuate notches respectively.

The first and second pairs of auxiliary spring members may be respectively anchored to the first and second swivel mounts in such a manner that the first and second swivel mounts may be resiliently articulated about the second axis during the golf swing motion. Advantageously, the first and second swivel mounts are preferably urged to respective equilibrium positions after being rotated about the second axis respectively. Such equilibrium positions may be respectively defined when the first and second pairs of the spring members are at equilibrium.

In one embodiment, he resiliently articulating mechanism may further include first and second locking tabs slidably mated to the medial faces of the first and second arm braces respectively. Such first and second locking tabs may be detachably engaged with the first and second swivel mounts in such a manner that the first and second swivel mounts are prohibited from articulating about the second axis and thereby remain at the respective equilibrium positions during the golf swing motion.

The present invention further includes a method for improving a user golf swing during driving, chipping and putting motions. Such a method preferably comprises the chronological steps of: providing and removably attaching first and second arm braces to user forearms respectively; providing a mechanism for pivotally mating the first arm brace to the second arm brace such that the first and second arm braces simultaneously pivot about a first axis; selectively toggling the pivotally mating mechanism between unlocked and locked positions such that a desired angle is adjustably and fixedly defined between the first and second arm braces during the golf swing motion respectively; and resiliently articulating the first and second arm braces about a second axis registered orthogonal to the first axis such that the first and second swivel mounts independently reciprocate along mutually exclusive arcuate paths adjoining the first and second arm braces respectively.

During driving motions, the desired angle may be a variable angle when the pivotally mating mechanism is at the unlocked position. During chipping and putting motions the desired angle is a fixed angle when the pivotally mating mechanism is at the locked position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

Figure 1:
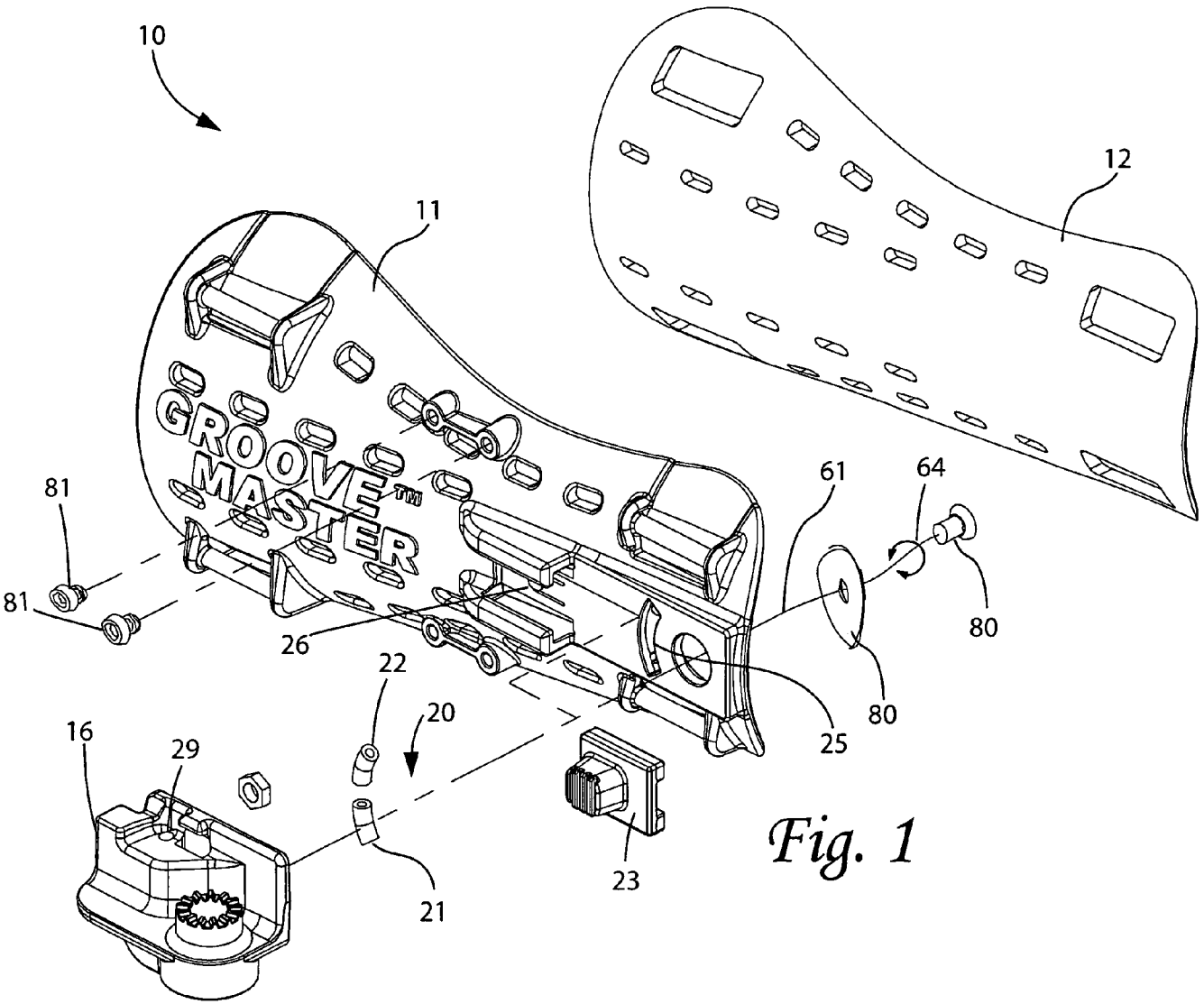
FIG. 1 is an exploded view showing the first arm brace a portion of an arm angle maintaining mechanism, in accordance with the present invention.

Those skilled in the art will appreciate that the figures are not intended to be drawn to any particular scale; nor are the figures intended to illustrate every embodiment of the invention. The invention is not limited to the exemplary embodiments depicted in the figures or the shapes, relative sizes or proportions shown in the figures.

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The multi-functional golf swing training apparatus of this invention is referred to generally in FIGS. 1-5 by the reference numeral 10 and is intended to provide a pivotally actuated training apparatus for aiding a golfer to maintain a desired angle during swinging, chipping and putting motions. It should be understood that the golf swing training apparatus 10 may be used to assist a golfer with many different types of swinging motions and should not be limited to any particular type of golf swing. These and other objects, features, and advantages of the invention are provided by a multi-functional golf swing training apparatus preferably including first and second arm braces 11, 14 adapted to be removably attached to user forearms respectively.

Figure 3:
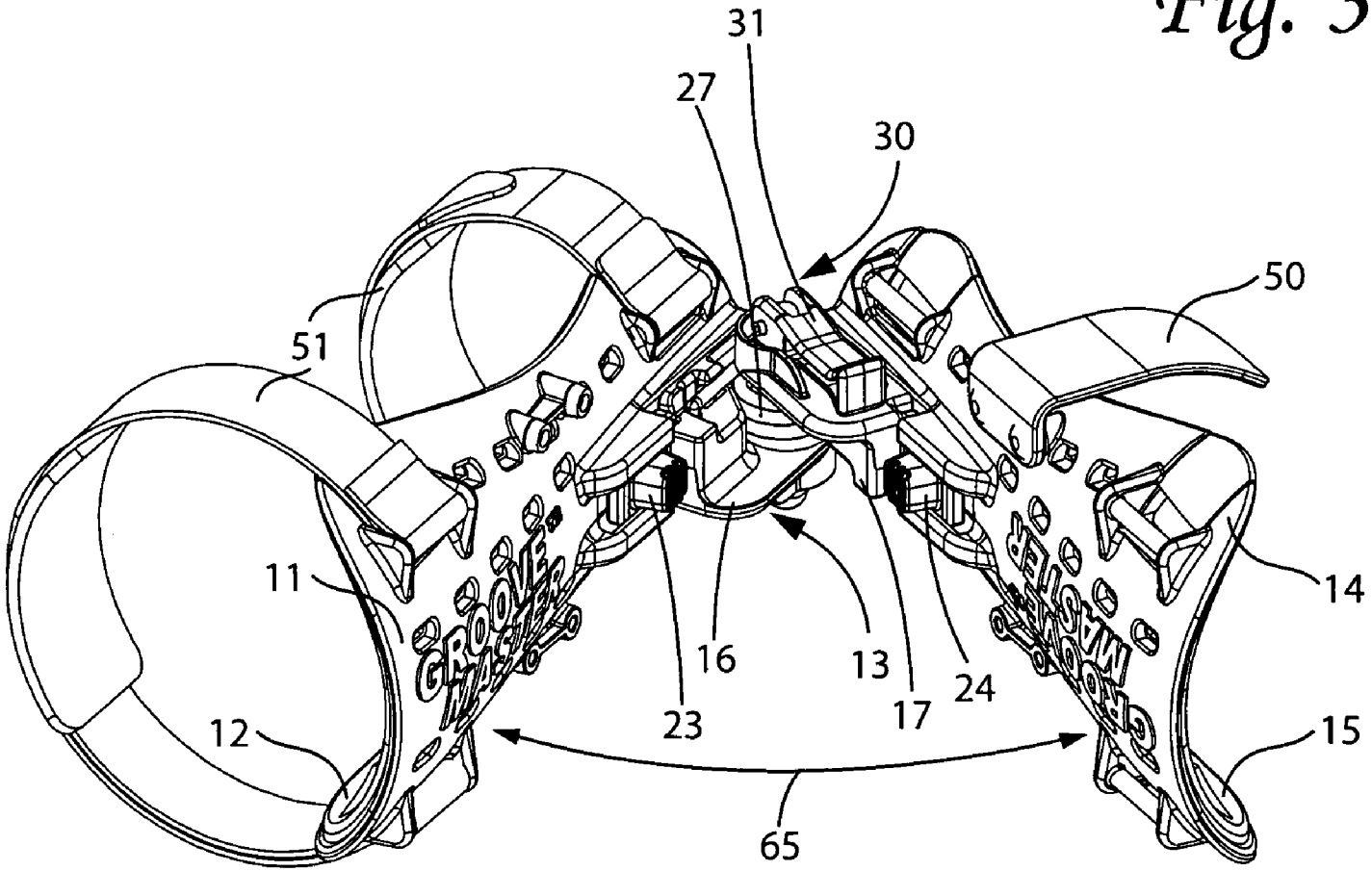
FIG. 3 is perspective view showing the first and second arm pivotally coupled by the arm angle maintaining mechanism at equilibrium.
Figure 4:
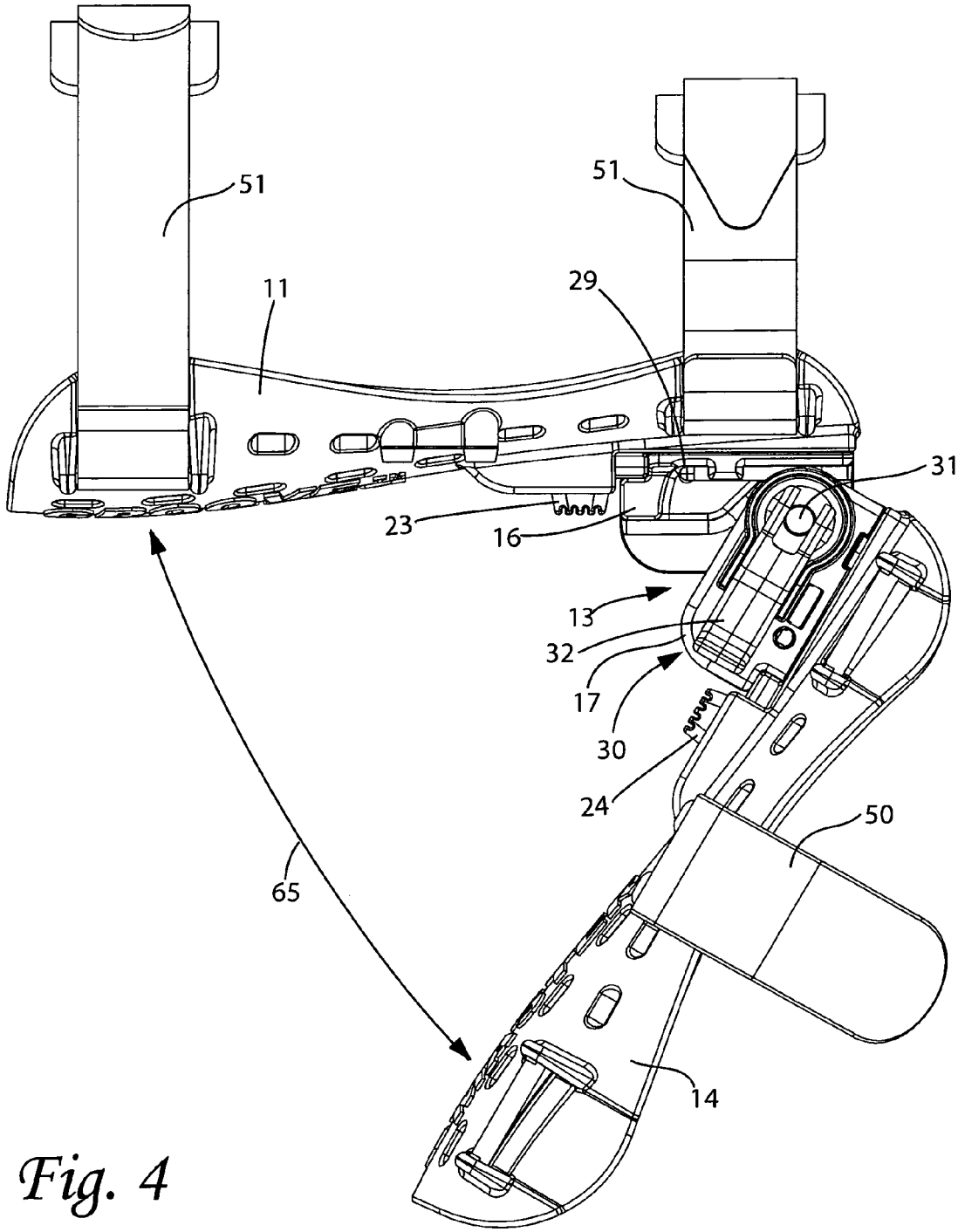
FIG. 4 is a top plan view of FIG. 1 showing the locking clip.
Figure 5:
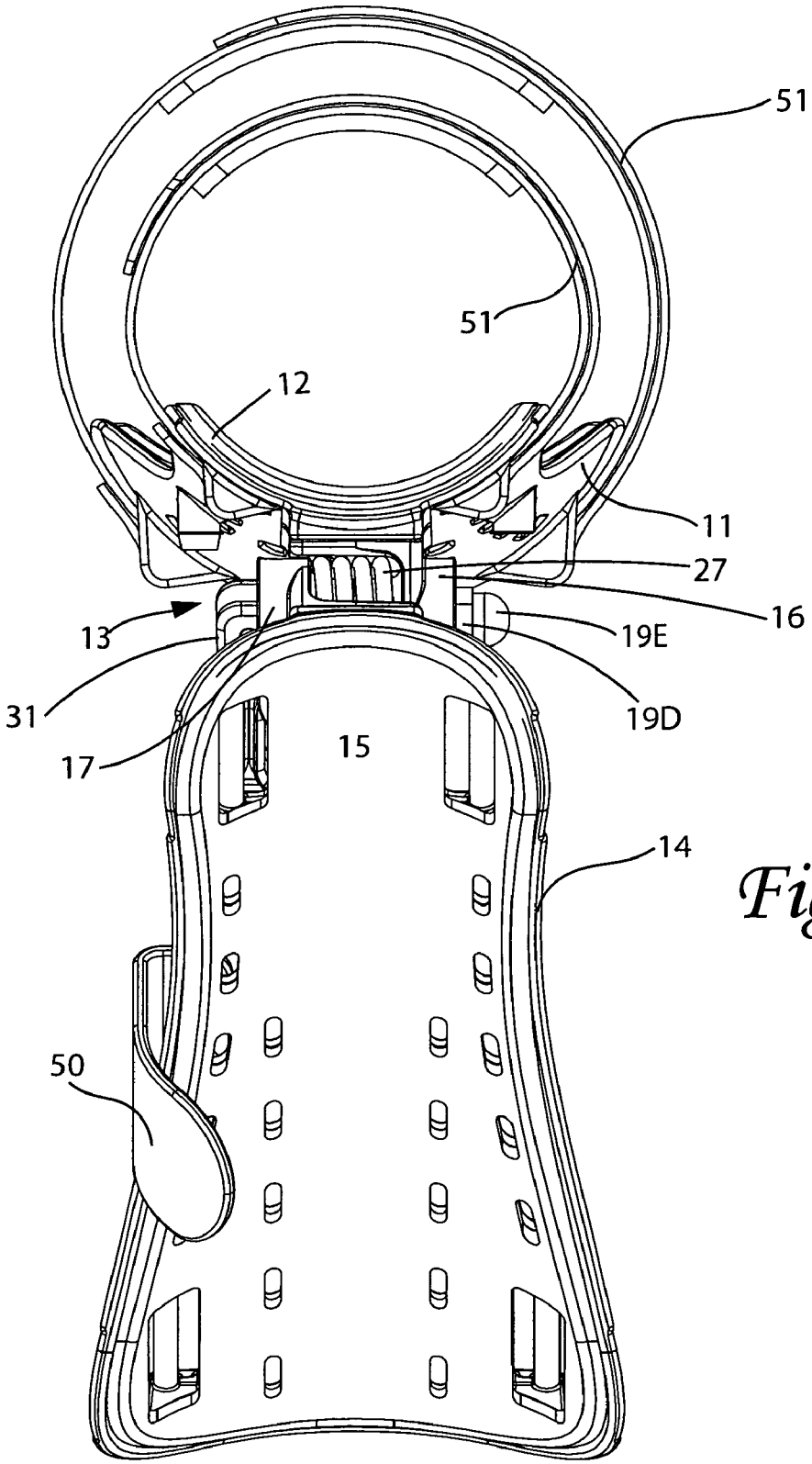
FIG. 5 is a front elevational view of FIG. 1 showing the angular relationship between the first and second arm braces at equilibrium.

In one embodiment, as perhaps best shown in FIGS. 3-5, the present invention may further include first and second support pads 12, 15 removably coupled to a corresponding lateral face of the first and second arm braces 11, 14 respectively for absorbing operating forces acting against the user forearms during the golf swing motion. Also, a plurality of flexible straps 51 may be wrapped about the first arm brace 11. Flexible straps 51 may be adapted to wrap about the user forearm for maintaining frictional surface contact between the first support pad 12 and the user forearm respectively. A second rigid strap 50 may extend from a longitudinal edge of the second arm brace 14 to help maintain the user forearm engaged therewith.

Figure 2:
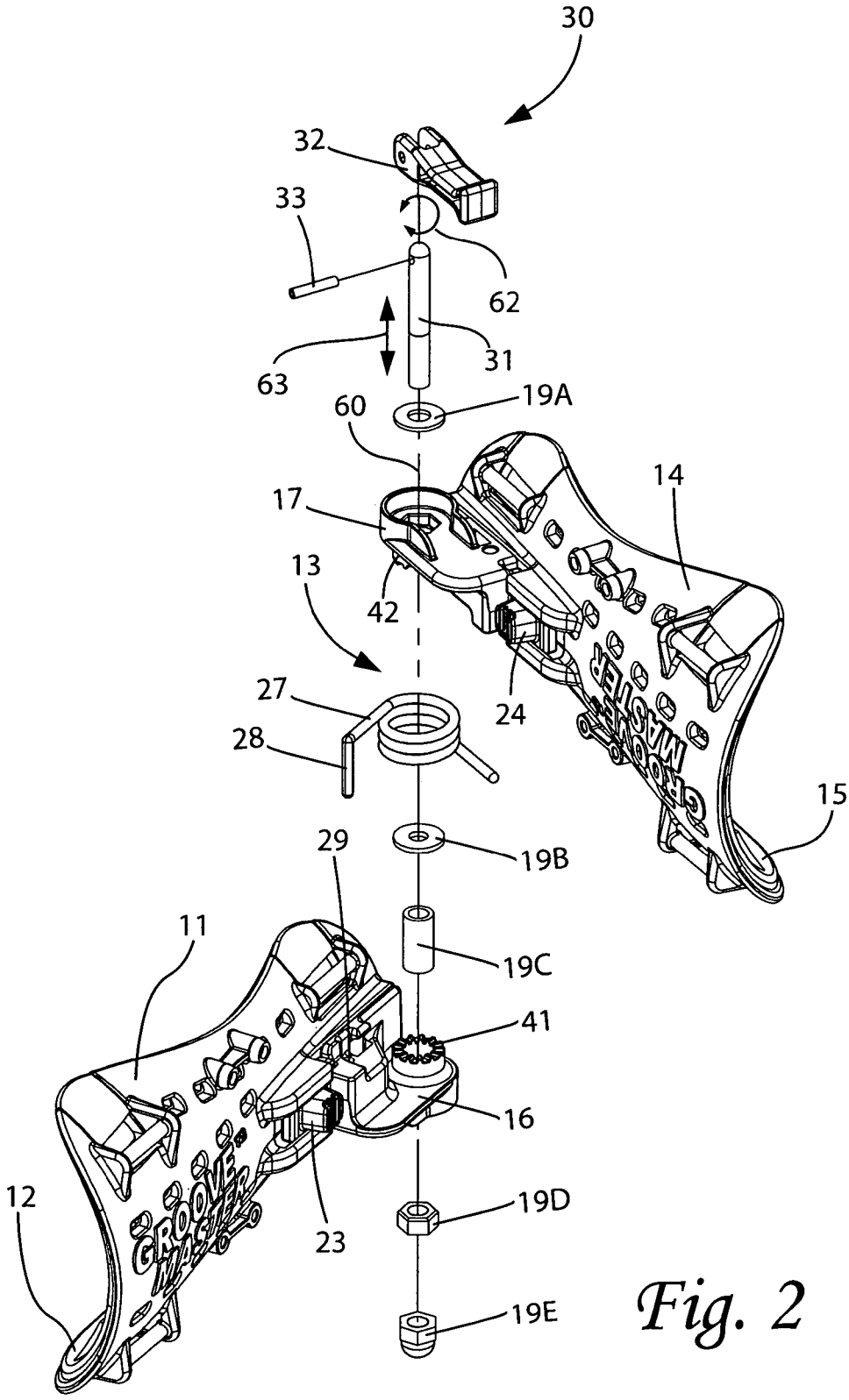
FIG. 2 is an exploded view showing the arm angle maintaining mechanism partially separated to the first and second arm brace.

Referring to FIGS. 1-2, the present invention 10 may further include a mechanism 13 for pivotally mating the first arm brace 11 to the second arm brace 14 such that the first and second arm braces 11, 14 simultaneously pivot about a first axis 60. Such a first axis 60 passes through respective proximal ends of the first and second swivel mounts 16, 17.

Advantageously, the pivotally mating mechanism 13 is selectively toggled between unlocked and locked positions such that a desired angle 65 is adjustably and fixedly defined between the first and second arm braces 11, 14 during a golf swing motion respectively. For example, during driving motions, the desired angle 65 may be a variable angle by toggling the pivotally mating mechanism 13 to the unlocked position. As another example, during chipping and putting motions, the desired angle 65 may be a fixed angle by toggling the pivotally mating mechanism 13 to the locked position.

As perhaps best shown in FIGS. 1-3, the pivotally mating mechanism 13 preferably includes first and second swivel mounts 16, 17 removably connected to a corresponding medial face of the first and second arm braces 11, 14 respectively. The second swivel mount 17 is preferably vertically stacked on the first swivel mount 16, and a spring member 27 is preferably intercalated between the first and second swivel mounts 16, 17. The spring member 27 is preferably arranged in such a manner that the spring member 27 contracts and expands about the first axis 60 to thereby separate the first and second arm braces 11, 14 to the desired angle. Of course, one skilled in the art understands that the desired angle may span between 0 and 180 degrees depending on the user's golf swing characteristics.

In one embodiment, the first swivel mount 16 may be provided with an orifice 29 formed therein. One end 28 of the spring member 27 may be removably interfitted within the orifice 29 such that the spring member 27 is prohibited from undesirably disengaging the first swivel mount 16 during the golf swing motion. Each of the first and second swivel mounts 16, 17 preferably includes a geared coupling 41, 42 facing the spring member 27 respectively. In this manner, the geared couplings 41, 42 may be interlocked to each other when the pivotally mating mechanism 13 axially compresses the spring member 27 along a linear travel path 63 defined along the first axis 60, as perhaps best sown in FIG. 2. Thus, the first and second arm braces 11, 14 are prohibited from pivoting along an arcuate path 62 defined about the first axis 60 during chipping and putting golf swing motions, for example.

Referring to FIGS. 2-4, the pivotally mating mechanism 13 may further include a cam lock 30 for toggling the pivotally mating mechanism 13 between the locked and unlocked positions. Such a cam lock 30 preferably includes a threaded pivot pin 31 linearly positioned through the geared couplings 41, 42 as well as the spring member 27 such that the pivot pin 31 is axially aligned with the first axis 60. The cam lock 30 may further include a locking arm 32 pivotally coupled to the pivot pin 31 and rotatably situated at the second swivel mount 17.

A locking pin 33 is traversed through the pivot pin 31 and the locking arm 32 respectively to thereby maintain the locking arm 32 pivotally connected to the pivot pin 31. A plurality of fastening members 19A-19E may be removably engaged to the pivot pin 31 to maintain the pivot pin 31 at a substantially stable position during the golf swing motion. Of skilled in the art understands, fastening members 19A-19E may be selectively employed as needed by the user.

As perhaps best shown in FIGS. 2-4, the pivot pin 31 is preferably linear and remains statically registered at a fixed position along the first axis 60 when the locking arm 32 is articulated to a locked lowered position. Further, the pivot pin 31 may be axially reciprocated along a linear path 63 registered parallel to the first axis 60 away from the fixed position when the locking arm 32 is articulated to a raised unlocked position and thereafter rotated in a corresponding annular direction 62 about the first axis 60 respectively. Thus, the geared couplings 41, 42 may be caused to travel toward each other and thereby axially compress the spring member 27 when the pivot pin 31 is axially displaced downwardly towards the first swivel mount 16.

The present invention discloses golf swing teaching apparatus that improves a golfer's full golf swing during driving, chipping and putting motions. The present invention advantageously places a user's arms and hands at a correct address (initial position) and thereby keeps a desired angle 65 between the user's arms during the entire swinging, chipping and putting motions. The training apparatus preferably includes first and second arm braces 11, 14 that form fit the forearms and create a V-like triangle position at address. As a result, at takeaway, the shoulders become connected and engaged, preventing the user from picking up the club with the hands or sliding away from the golf ball. During the backswing, the present invention causes the shoulder to round out and create a one piece take away.

At half way through the top of the back swing, the leading take away arm is allowed to transition in the correct position due to the pivotally mating mechanism 13 that mates with cam lock 30. Because the angle of the user's forearms will be at varying degrees, the spring member 27 allows the device to stay connected to the user's arms by contracting and expanding the spring member 27 as necessary. This allows the correct motion to enable the user forearms to be placed in the correct position on the top of the back swing.

On the down swing, the present invention engages the golfer's core allowing the hips to initiate the downswing. It keeps the hips, shoulders and arms turning in sequence while the golfer unwinds. This results in maximum angle retention between the club shaft and the lead arm which allows generation of a maximum speed when impacting the golf ball. This is done in part because the present invention allows the golfer to maintain all the correct angles throughout the swing.

Advantageously, the present invention provides the unpredictable and unexpected ability to correct tempo and sequence shortcomings during the golf swing. Thus, the golfer is prevented from jerking or rushing the arms to begin the downswing. It keeps the arm speed aligned with the hip speed and thereby creates dynamic sequence in the golf swing motion.

At impact, the golfer's hips, arms and shoulders deliver the club with accurate precision to the impact position. This is achieved because the present invention puts the user in the correct setup position plus initiates a correct takeaway and sequence angle as well as ensures accurate motion to impact. With the dynamic sequence that is generated by the present invention, the golfer will, inter alia: create and retain improved angle during the downswing; eliminate coming over the top and slicing the golf ball; eliminate flipping the golf ball and creating flat shots at impact; eliminate early or premature release of the golf club; and create the proper position to keep the golf club in front of the body while reducing the possibility of getting stuck. Thus, the present invention creates improved synergy and sequence between the arms, shoulders and hips during the entire swing, and thereby generates more club head speed and imparts an exceptional solid hit on the back of the golf ball.

When putting, golfers tend to change the angle of their arms and use too much of their wrists. This shortcoming is why struck putts do not find the bottom of the cup. Not maintaining a consistent wrist and arm angle creates a wobbly action that is transmitted down to the putter face and to the golf ball, which causes the golf ball to go just about anywhere except where it is intended to go.

To overcome this shortcoming, the first and second arm braces 11, 14 of the present invention preferably form fit the user's forearms and create a V-like triangle position at address (initial position). To maintain a consistent angle throughout the entire chipping and putting golf swing motion, the present invention includes a pair of locking members 23, 24 for preventing desired angle 65 from changing. Such locking members 23, 24 can be applied at varying angular degrees from 0 degrees to 180 degrees, for example, to accommodate a golfer's preferred putting angle. When locked into place, the shoulders and arms sequentially move together while maintaining the desired angle 65 throughout the chipping and putting gulf swing motion.

Accordingly, the shortcoming of flipping the wrist and changing the putting stroke angle are reduced. In particular, a consistent putting angle will be maintained throughout the entire putting stroke. The possibility of using wrist action is significantly eliminated which results in the elimination of the wobbly action transmitted to the golf ball. Such a combination of elements provides a more consistent putting stroke for short, medium and long putts.

Another aspect of the present invention is to improve a chipping during golf swing motions. Chipping is an extension of the full driving swing and an extended version of a short putting swing. When chipping, it is desired to create and maintain the desired angle 65 between the golfer's arms, especially angles created by the trailing wrist (right wrist for right handed golfers). The present invention helps ensure the desired angle 65 is maintained because it encourages the trailing arm and wrist to push against the leading arm and wrist, respectively. In this manner, the present invention creates a bowed effect without forcibly squeezing the arms and wrist together, which causes breakdown and bad swing habits.

Such advantages are achieved in one embodiment, wherein the present invention further includes a mechanism 20 for resiliently articulating the first and second arm braces 11, 14 about a second axis 61, as perhaps best shown in FIG. 1. Such a second axis 61 may be registered orthogonal to the first axis 60 such that the first and second swivel mounts 16, 17 independently reciprocate 63 along mutually exclusive arcuate paths 64 adjoining the first and second arm brace 11, 14 respectively.

Such a resiliently articulating mechanism 30 preferably includes first and second arcuate notches 25 formed in the medial faces of the first and second arm braces 11, 14 respectively. A first pair of auxiliary spring members 21, 22 is interfitted within a first notch 25 respectively. It is noted that although FIG. 1 shows only the first arm brace 11 with the first pair of auxiliary spring members 21, 22 in relation with the first notch 25, mechanism 20 also includes a second pair of auxiliary spring members interfitted within a notch of the second arm brace 14 respectively. The second notch is structurally and functionally identical to the first notch 25. Likewise, the second pair of auxiliary spring members are structurally and functionally identical to the first pair of auxiliary spring members 21, 22.

Such first 21, 22 and second pairs of auxiliary spring members may be respectively anchored to the first and second swivel mounts 16, 17 in such a manner that the first and second swivel mounts 16, 17 may be resiliently articulated about the second axis 61 during the golf swing motion. Advantageously, the first and second swivel mounts 16, 17 are preferably urged to respective equilibrium positions after being rotated about the second axis 61 respectively. Such equilibrium positions may be respectively defined when the first 21, 22 and second pairs of the spring members rest at equilibrium inside the respective notches.

As further shown in FIG. 1, fasteners 80 may be sued to secure the first swivel mount 16 to the first arm brace 11 (likewise for the second swivel mount 17 and second arm brace 17). Also, fasteners 81 may be used to secure support pad 12 to the first arm brace 11 (likewise for the second support pad 15 and second arm brace 17).

In one embodiment, the resiliently articulating mechanism 30 may further include first and second locking tabs 23, 24 slidably mated to the medial faces of the first and second arm braces 11, 14 respectively. Such first and second locking tabs 23, 24 may be detachably engaged with the first and second swivel mounts 16, 17 in such a manner that the first and second swivel mounts 16, 17 are prohibited from articulating about the second axis 61 and thereby remain at the respective equilibrium positions during the golf swing motion.

The present invention further includes a method for improving a user golf swing during driving, chipping and putting motions. Such a method preferably comprises the chronological steps of: providing and removably attaching first and second arm braces 11, 14 to user forearms respectively; providing a mechanism for pivotally mating the first arm brace 11 to the second arm brace 14 such that the first and second arm braces 11, 14 simultaneously pivot about a first axis 60; selectively toggling the pivotally mating mechanism 13 between unlocked and locked positions such that a desired angle 65 is adjustably and fixedly defined between the first and second arm braces 11, 14 during the golf swing motion respectively; and resiliently articulating the first and second arm braces 11, 14 about a second axis 61 registered orthogonal to the first axis 60 such that the first and second swivel mounts 16, 17 independently reciprocate along mutually exclusive arcuate paths 64 adjoining the first and second arm braces 11, 14 respectively.

During driving motions, the desired angle 65 may be a variable angle when the pivotally mating mechanism 13 is at the unlocked position. During chipping and putting motions the desired angle 65 is a fixed angle when the pivotally mating mechanism 13 is at the locked position.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A multi-functional golf swing training apparatus for improving a user golf swing during driving, chipping and putting motions, said multi-functional golf swing training apparatus comprising:

first and second arm braces adapted to be removably attached to user forearms respectively; and means for pivotally mating said first arm brace to said second arm brace such that said first and second arm braces simultaneously pivot about a first axis;

wherein said pivotally mating means is selectively toggled between unlocked and locked positions such that a desired angle is adjustably and fixedly defined between said first and second arm braces during a golf swing motion respectively;

wherein said desired angle is a variable angle when said pivotally mating means is at the unlocked position;

wherein said desired angle is a fixed angle when said pivotally mating means is at the locked position;

wherein said pivotally mating means comprises:

first and second swivel mounts removably connected to a corresponding medial face of said first and second arm braces respectively, said second swivel mount being vertically stacked on said first swivel mount; and a spring member intercalated between said first and second swivel mounts, said spring member being arranged in such a manner that said spring member contracts and expands about the first axis to thereby separate said first and second arm braces to the desired angle;

wherein said first axis passes through respective proximal ends of said first and second swivel mounts.

2. The multi-functional golf training apparatus of claim 1, further comprising: means for resiliently articulating said first and second arm braces about a second axis registered orthogonal to the first axis such that said first and second swivel mounts independently reciprocate along mutually exclusive arcuate paths adjoining said first and second arm braces respectively.

3. The multi-functional golf training apparatus of claim 2, wherein said resiliently articulating means comprises:

first and second arcuate notches formed in said medial faces of said first and second arm braces respectively;

first and second pairs of auxiliary spring members interfitted within said first and second arcuate notches respectively;

wherein said first and second pairs of auxiliary spring members are respectively anchored to said first and second swivel mounts in such a manner that said first and second swivel mounts are resiliently articulated about the second axis during the golf swing motion;

wherein said first and second swivel mounts are urged to respective equilibrium positions after being rotated about the second axis respectively;

wherein said equilibrium positions are respectively defined when said first and second pairs of said spring members are at equilibrium.

4. The multi-functional golf training apparatus of claim 3, wherein said resiliently articulating means further comprises: first and second locking tabs slidably mated to said medial faces of said first and second arm braces respectively, said first and second locking tabs being detachably engaged with said first and second swivel mounts in such a manner that said first and second swivel mounts are prohibited from articulating about the second axis and thereby remain at the respective equilibrium positions during the golf swing motion.

5. A multi-functional golf swing training apparatus for improving a user golf swing during driving, chipping and putting motions, said multi-functional golf swing training apparatus comprising:

first and second arm braces adapted to be removably attached to user forearms respectively; and means for pivotally mating said first arm brace to said second arm brace such that said first and second arm braces simultaneously pivot about a first axis;

wherein said pivotally mating means is selectively toggled between unlocked and locked positions such that a desired angle is adjustably and fixedly defined between said first and second arm braces during a golf swing motion respectively;

wherein said desired angle is a variable angle when said pivotally mating means is at the unlocked position;

wherein said desired angle is a fixed angle when said pivotally mating means is at the locked position;

wherein said pivotally mating means comprises:

first and second swivel mounts removably connected to a corresponding medial face of said first and second arm braces respectively, said second swivel mount being vertically stacked on said first swivel mount; and a spring member intercalated between said first and second swivel mounts, said spring member being arranged in such a manner that said spring member contracts and expands about the first axis to thereby separate said first and second arm braces to the desired angle;

wherein said first axis passes through respective proximal ends of said first and second swivel mounts.

6. The multi-functional golf swing training apparatus of claim 5, wherein each of said first and second swivel mounts comprises: a geared coupling facing said spring member respectively, said geared couplings being interlocked to each other when said pivotally mating means axially compresses said spring member along the first axis and thereby prohibit said first and second arm braces from pivoting about the first axis during the golf swing motion.

7. The multi-functional golf training apparatus of claim 6, wherein said pivotally mating means further comprises: a cam lock for toggling said pivotally mating means between the locked and unlocked positions, said cam lock comprising a pivot pin linearly positioned through said geared couplings as well as said spring member such that said pivot pin is axially aligned with the first axis;

a locking arm pivotally coupled to said pivot pin and rotatably situated at said second swivel mount;

a locking pin traversed through said pivot pin and said locking arm respectively to thereby maintain said locking arm pivotally connected to said pivot pin; and a plurality of fastening members removably engaged to said pivot pin to maintain said pivot pin at a substantially stable position during the golf swing motion.

8. The multi-functional golf training apparatus of claim 7, wherein said pivot pin is linear and remains statically registered at a fixed position along the first axis when said locking arm is articulated to a locked lowered position, said pivot pin being axially reciprocated away from said fixed position when said locking arm is articulated to a raised unlocked position and thereafter rotated in a corresponding annular direction about the first axis respectively;

wherein said geared couplings are caused to travel toward each other and thereby axially compress said spring member when said pivot pin is axially displaced downwardly towards said first swivel mount.

9. The multi-functional golf training apparatus of claim 5, wherein said first swivel mount is provided with an orifice formed therein, one end of said spring member being removably interfitted within said orifice such that said spring member is prohibited from undesirably disengaging said first swivel mount during the golf swing motion.

10. The multi-functional golf training apparatus of claim 5, further comprising: means for resiliently articulating said first and second arm braces about a second axis registered orthogonal to the first axis such that said first and second swivel mounts independently reciprocate along mutually exclusive arcuate paths adjoining said first and second arm braces respectively.

11. The multi-functional golf training apparatus of claim 10, wherein said resiliently articulating means comprises:

first and second arcuate notches formed in said medial faces of said first and second arm braces respectively;

first and second pairs of auxiliary spring members interfitted within said first and second arcuate notches respectively;

wherein said first and second pairs of auxiliary spring members are respectively anchored to said first and second swivel mounts in such a manner that said first and second swivel mounts are resiliently articulated about the second axis during the golf swing motion;

wherein said first and second swivel mounts are urged to respective equilibrium positions after being rotated about the second axis respectively;

wherein said equilibrium positions are respectively defined when said first and second pairs of said spring members are at equilibrium.

12. The multi-functional golf training apparatus of claim 11, wherein said resiliently articulating means further comprises: first and second locking tabs slidably mated to said medial faces of said first and second arm braces respectively, said first and second locking tabs being detachably engaged with said first and second swivel mounts in such a manner that said first and second swivel mounts are prohibited from articulating about the second axis and thereby remain at the respective equilibrium positions during the golf swing motion.

13. The multi-functional golf training apparatus of claim 5, further comprising: first and second support pads removably coupled to a corresponding lateral face of said first and second arm braces respectively for absorbing operating forces acting against the user forearms during the golf swing motion.

14. The multi-functional golf training apparatus of claim 5, further comprising: a plurality of flexible straps wrapped about each of said first and second arm braces, said flexible straps being adapted to wrap about the user forearms for maintaining frictional surface contact between said first and second support pads and the user forearms respectively.

15. A method for improving a user golf swing during driving, chipping and putting motions, said method comprising the chronological steps of:

providing and removably attaching first and second arm braces to user forearms respectively;

providing a mechanism for pivotally mating said first arm brace to said second arm brace such that said first and second arm braces simultaneously pivot about a first axis;

selectively toggling said pivotally mating mechanism between unlocked and locked positions such that a desired angle is adjustably and fixedly defined between said first and second arm braces during the golf swing motion respectively; and resiliently articulating said first and second arm braces about a second axis registered orthogonal to the first axis such that said first and second swivel mounts independently reciprocate along mutually exclusive arcuate paths adjoining said first and second arm braces respectively;

wherein said desired angle is a variable angle when said pivotally mating mechanism is at the unlocked position;

wherein said desired angle is a fixed angle when said pivotally mating mechanism is at the locked position.

* * * * *